US008337000B2

(12) United States Patent
Paku et al.

(10) Patent No.: US 8,337,000 B2
(45) Date of Patent: Dec. 25, 2012

(54) INKJET PRINT HEAD AND INK STORAGE APPARATUS

(75) Inventors: Chonsun Paku, Joso (JP); Kayo Mukai, Nagareyama (JP); Yuichi Takahashi, Yoshikawa (JP)

(73) Assignee: Canon Finetech Inc., Joso-Shi (JP)

( * ) Notice: Subject to any disclaimer, the term of this patent is extended or adjusted under 35 U.S.C. 154(b) by 365 days.

(21) Appl. No.: 12/701,471

(22) Filed: Feb. 5, 2010

(65) Prior Publication Data

US 2010/0201765 A1 Aug. 12, 2010

(30) Foreign Application Priority Data

Feb. 9, 2009 (JP) ..... 2009-027194
Jan. 27, 2010 (JP) ..... 2010-015550

(51) Int. Cl.
*B41J 2/175* (2006.01)

(52) U.S. Cl. ..... 347/86; 347/87

(58) Field of Classification Search ..... 347/84, 347/85, 86, 87

See application file for complete search history.

(56) References Cited

U.S. PATENT DOCUMENTS

| | | | | |
|---|---|---|---|---|
| 4,968,998 | A * | 11/1990 | Allen | 347/7 |
| 5,815,185 | A | 9/1998 | Pietrzyk | 347/92 |
| 6,007,193 | A | 12/1999 | Kashimura et al. | 347/92 |
| 6,036,305 | A * | 3/2000 | Nagasaki et al. | 347/86 |
| 6,155,679 | A | 12/2000 | Sato | 347/92 |
| 6,364,473 | B1 | 4/2002 | Liu | 347/85 |
| 6,540,321 | B1 * | 4/2003 | Hirano et al. | 347/22 |
| 6,846,072 | B2 * | 1/2005 | Sato et al. | 347/86 |
| 7,275,816 | B2 | 10/2007 | Mukai et al. | 347/86 |
| 7,841,684 | B2 * | 11/2010 | Morgan et al. | 347/17 |
| 8,070,270 | B2 * | 12/2011 | Ito et al. | 347/85 |
| 2005/0062818 | A1 | 3/2005 | Hashi et al. | 347/92 |
| 2006/0132554 | A1 | 6/2006 | Ota et al. | 347/85 |
| 2007/0120913 | A1 | 5/2007 | Mukai et al. | 347/93 |
| 2007/0279567 | A1 | 12/2007 | Matsushima | 349/143 |
| 2008/0273046 | A1 | 11/2008 | Ishinaga et al. | 347/6 |
| 2009/0147064 | A1 | 6/2009 | Ito et al. | 347/92 |
| 2009/0153630 | A1 | 6/2009 | Ito et al. | 347/85 |
| 2009/0160915 | A1 | 6/2009 | Takahashi et al. | 347/85 |

FOREIGN PATENT DOCUMENTS

| | | |
|---|---|---|
| EP | 968829 | 1/2000 |
| EP | 986829 | 1/2000 |
| EP | 1090766 | 4/2001 |
| EP | 2127886 | 12/2009 |
| GB | 2326379 | 12/1998 |
| JP | 10-250079 | 9/1998 |

(Continued)

OTHER PUBLICATIONS

European Search Report dated Apr. 28, 2010 from corresponding European Application No. 10152918.8.

(Continued)

*Primary Examiner* — Anh T. N. Vo
(74) *Attorney, Agent, or Firm* — Fitzpatrick, Cella, Harper & Scinto

(57) ABSTRACT

An objective of the invention is to provide an improved ink storage apparatus and an inkjet print head including the ink storage apparatus. Furthermore, an effective elimination of the air bubbles flowed into or generated in the print head is realized by an ink storage apparatus and an inkjet print head including the ink storage apparatus.

14 Claims, 16 Drawing Sheets

FOREIGN PATENT DOCUMENTS

| | | |
|---|---|---|
| JP | 2002-144576 | 5/2002 |
| JP | 2003-053985 | 2/2003 |
| JP | 2005-096208 | 4/2005 |
| JP | 2005-212184 | 8/2005 |
| JP | 2006-326855 | 12/2006 |
| JP | 2007-168421 | 7/2007 |
| JP | 2007-327997 | 12/2007 |
| JP | 2008-003025 | 1/2008 |
| WO | 2008/006139 | 1/2008 |

OTHER PUBLICATIONS

Japanese Office Action dated Aug. 31, 2012 in counterpart Japanese Patent Application No. 2010-015550 and English language translation thereof.

* cited by examiner

INKJET PRINT HEAD AND INK STORAGE APPARATUS

BACKGROUND OF THE INVENTION

1. Field of the Invention

The present invention relates to an ink storage apparatus for storing ink supplied to an ink ejecting section for ejecting liquid to a print medium and a print head including the ink storage apparatus.

2. Description of the Related Art

An inkjet print apparatus has been known in which ink is ejected through a print head to a print medium to perform printing. Such an inkjet print apparatus (hereinafter also simply referred to as a print apparatus) generally performs a high-definition printing by a small print head in which a plurality of nozzles for ejecting ink are formed with a high density.

By arranging the small print heads and supplying inks of different colors to the respective print heads, a color printing of a print medium can be performed with a relatively low cost and small configuration. Thus, the inkjet print apparatus has been used for various print apparatuses for business and family uses such as a printer, a facsimile, and a copier.

In the inkjet print apparatus as described above, an ink supply system for supplying ink to a recording head generally includes therein a negative pressure generating means. Ink subjected to the negative pressure by the negative pressure generating means is supplied to a print head and an ink ejecting element performs an ink ejecting operation. In order to stabilize the ink ejecting operation in the print head as described above, what is important is how to process air bubbles mixed in or generated in the print head.

Japanese Patent Laid-Open No. H10-250079 (1998) discloses a configuration in which an ink ejecting section includes therein at least one chambers for air bubbles generated from the ink ejecting element so that the generated air bubbles are accumulated in the chamber. In the case of this configuration, when the capacity of the chamber reaches its limit, an ink supply flow path is blocked by air bubbles to prevent ink supply, causing an inoperable status. Thus, this configuration requires an ink tank as a consumable good to include an ink ejecting section and the ink tank must be exchanged with the new one before the limit of the chamber capacity is reached.

Another print head configuration in which an ink tank and an ink ejecting section are separately provided is disclosed in Japanese Patent Laid-Open No. 2007-168421. This print head includes a main high-capacity liquid chamber and a plurality of low-capacity liquid chambers that are formed via a filter and that communicate with one another. All of the liquid chambers are filled with ink. By using the configuration as described above to feed ink into the print head, air bubbles flowing into and generated in the print head can be caused to remain in the filter section and can be emitted without causing an increased flow path resistance.

In the case of this configuration however, ink is desirably supplied through a circulating system because emitted ink is unused as waste liquid. This may cause a possibility where ink is deteriorated due to the heat from the ink ejecting section. This also limits applicable negative pressure generating means. Therefore, this configuration cannot be used to a configuration as disclosed in Japanese Patent Laid-Open No. 2006-326855 in which a fan is directly connected to a print head to actively control a negative pressure.

Another configuration is disclosed in Japanese Patent Laid-Open No. 2008-03025. In this configuration, one space in a print head liquid chamber includes both of an ink layer and an air layer and a liquid chamber includes an exhaust opening that is connected to the air layer separately from an ink supply opening and an ink eject opening and that is opened to the outside. By the configuration as described above, air bubbles flowing into and generated in the print head are caused to move upward to reach the air layer and air in air bubbles is emitted via the exhaust opening to the outside.

However, the ink layer and the air layer have an unclear interface therebetween because a conventional print head has a difficulty in securely eliminating the air bubbles from the ink layer through the air layer (hereinafter vapor-liquid separation). This has caused a possibility where the air layer is filled with air bubbles. This has caused a possibility where air bubbles may enter an unexpected part to thereby cause a failure. One example is a disadvantage that the unclear interface between the ink layer and the air layer prevents an appropriate control of the amount of ink in the print head.

Therefore, it is required to eliminate the air bubbles flowed into or generated in the ink storage apparatus of the print head and to effectively realize the vapor-liquid separation.

SUMMARY OF THE INVENTION

It is an objective of the present invention to provide an improved ink storage apparatus and an inkjet print head including the ink storage apparatus. It is another objective of the present invention to realize an effective elimination of the air bubbles flowed into or generated in the print head by an ink storage apparatus and an inkjet print head including the ink storage apparatus.

The ink storage apparatus of the present invention is an ink storage apparatus for storing ink supplied to an ink ejecting section for ejecting liquid to a print medium, characterized in comprising: a liquid chamber for storing the ink, an air chamber connected to the liquid chamber, a supply opening for supplying ink to the liquid chamber, a guide face that is provided at an upper part of the liquid chamber and that is raised from the supply opening-side to the air chamber-side, and an air flow path opening that is provided in the air chamber and that is connected to an outside.

Furthermore, the inkjet print head of the present invention is an inkjet print head that is characterized that, in an inkjet print head for ejecting ink from an ejecting section to thereby perform printing on a print medium, the ejecting section includes the ink storage chamber.

According to the present invention, the air bubbles generated in the ink storage chamber and the air bubbles in the ink storage chamber can be efficiently moved, thus realizing a printing with stably-ejected ink.

Further features of the present invention will become apparent from the following description of exemplary embodiments (with reference to the attached drawings).

DESCRIPTION OF THE EMBODIMENTS (First Embodiment)

The following section will describe the first embodiment of the present invention with reference to the drawings.

Figure 1:
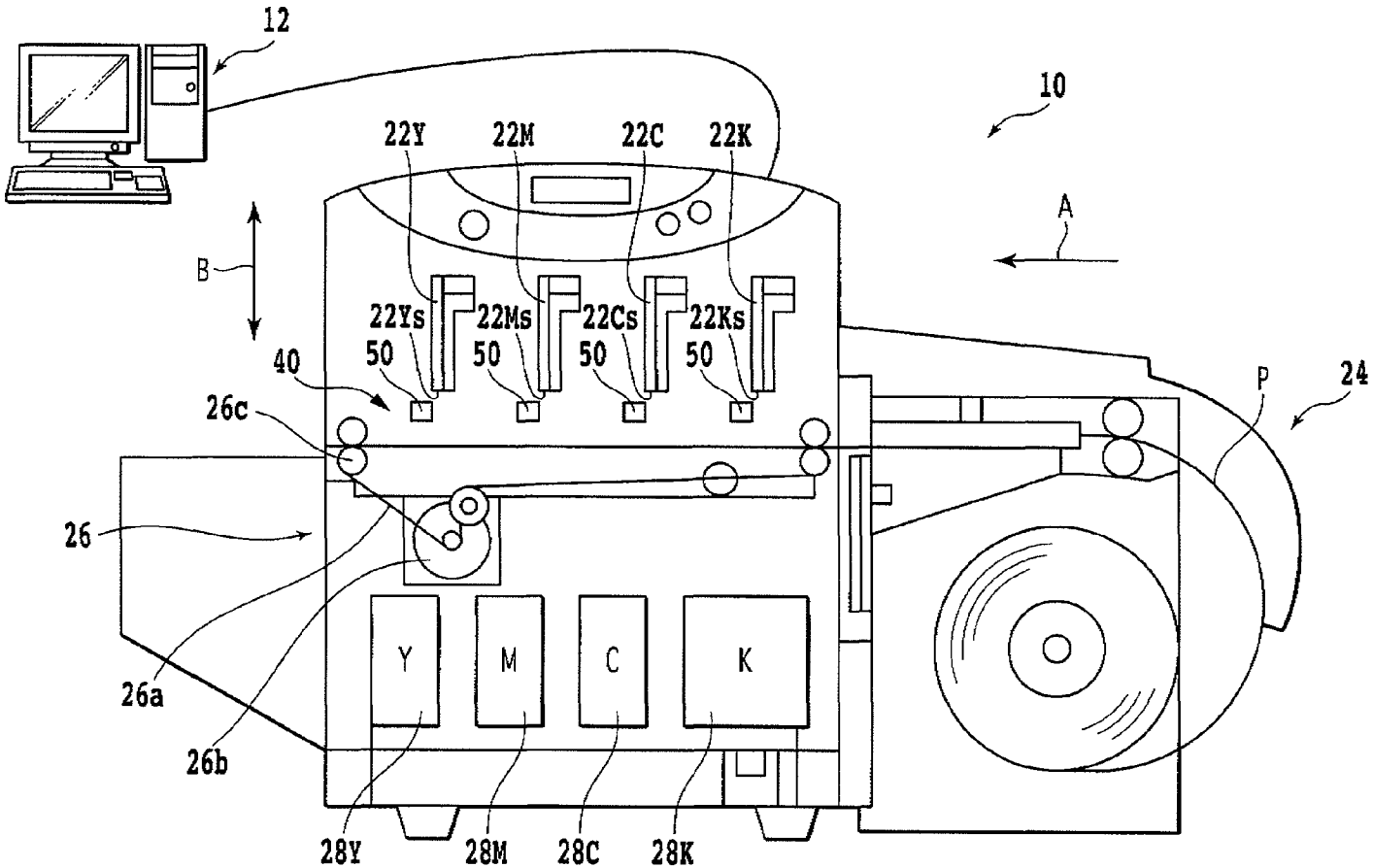
FIG. 1 is a front view schematically illustrating an inkjet print apparatus to which the first embodiment can be applied.

FIG. 1 is a front view schematically illustrating an inkjet print apparatus to which the first embodiment can be applied (hereinafter simply referred to as a print apparatus). A print apparatus 10 is connected to a host PC 12. Based on the recording information sent from the host PC 12, ink is ejected through four head units 22K, 22C, 22M, and 22Y to a print medium (hereinafter also referred to as a roll paper) P to perform printing.

The four head units 22K, 22C, 22M, and 22Y are arranged in a direction along which a print medium P is fed (direction shown by the arrow A). The respective head units are arranged along the feed direction in an order from a black ink head unit 22K, a cyan ink head unit 22C, a magenta ink head unit 22M, and a yellow ink head unit 22Y. The head units 22K, 22C, 22M, and 22Y are a so-called line head and are provided to be parallel to one another in the print medium feeding direction over the entire print width. When the print apparatus performs printing, heaters provided in the respective head units are driven without moving the head units to thereby eject ink through nozzles to perform printing.

In accordance with the progress of the printing, there may be a case where foreign material (e.g., dust or ink droplets) are attached to faces including nozzles of the head units (hereinafter also referred to as ink ejecting opening faces) 22Ks, 22Cs, 22Ms, and 22Ys to cause a change in the ejecting status, which may have an influence on the printing. To prevent this, the print apparatus 10 includes a recovery unit 40 so that ink can be stably ejected through the respective head units 22K, 22C, 22M, and 22Y. By using this recovery unit 40 to clean the ink ejecting opening faces periodically, the ink ejecting status of the nozzles of the head units 22K, 22C, 22M, and 22Y can be recovered to a favorable ink ejecting status at an initial stage.

The recovery unit 40 includes caps 50 for removing, during a cleaning operation, the ink in the ink ejecting opening faces 22Ks, 22Cs, 22Ms, and 22Ys of the four head units 22K, 22C, 22M, and 22Y. The caps 50 are independently provided to the respective head units 22K, 22C, 22M, and 22Y. The cap 50 is composed of a blade, an ink removal member, a blade retention member, and a cap for example.

The print medium P is supplied from a roll paper supply unit 24 and is fed by a feed mechanism 26 provided in the print apparatus 10 in the direction shown by the arrow A. The feed mechanism 26 is composed of a feed belt 26*a* for feeding the roll paper P while having the roll paper P thereon, a feed motor 26*b* for rotating the feed belt 26*a*, and a roller 26*c* for providing tension to the feed belt 26*a* for example.

A printing operation is performed in the manner as described below. Specifically, when the fed roll paper P reaches a position under the black head unit 22K, based on the print information sent from the host PC 12, black ink is ejected through the head unit 22K. Similarly, inks of the respective colors are ejected in an order from the head unit 22C, the head unit 22M, and the head unit 22Y therethrough to thereby complete the color printing on the roll paper P.

Furthermore, the print apparatus 10 also includes main tanks 28K, 28C, 28M, and 28Y for storing ink supplied to the respective head units, a pump that can supply ink to the respective head units, and a pump for performing a cleaning operation (which will be described later) (see FIG. 3 for example) for example.

Figure 2:
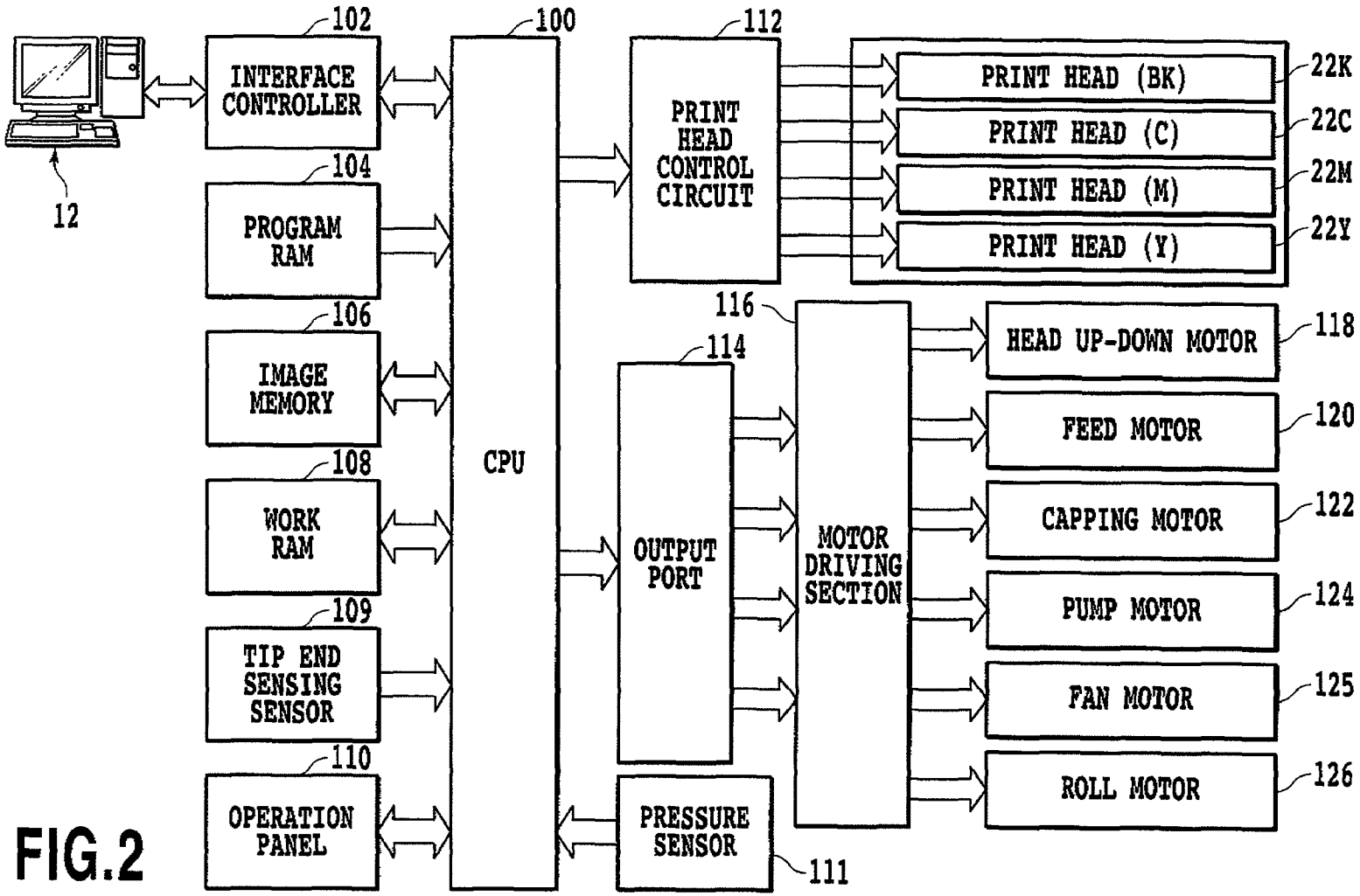
FIG. 2 is a block diagram illustrating a control system of the print apparatus of FIG. 1.

FIG. 2 is a block diagram illustrating the control system of the print apparatus 10 of FIG. 1. Print information and a command sent from the host PC (host apparatus) 12 is received by a CPU 100 via an interface controller 102. The CPU 100 is a computation processing apparatus that provides the control of general operations (e.g., the reception of the print information from the print apparatus 10, a printing operation, and the handling of the roll paper P). The CPU 100 analyzes the received command and then subjects the image data of the respective color components of the print data to a bitmap development in an image memory 106 to draw the image. In the operation processing performed prior to the printing, a capping motor 122 and a head up-down motor 118 are driven via an output port 114 and a motor driving section 116 and the respective head units 22K, 22C, 22M, and 22Y are moved to a printing position away from the cap 50.

The CPU 100 also performs a control as described later for correcting, as required, the rotation of a fan motor of a fan for applying an appropriate negative pressure to the head units 22K, 22C, 22M, and 22Y based on the pressure information obtained from the pressure sensor. The CPU 100 also performs a control for driving a roll motor 126 for feeding the roll paper P via the output port 114 and the motor driving section 116 and the feed motor 120 for feeding the roll paper P for example to feed the roll paper P to the printing position.

When a printing is performed, in order to determine a timing (print timing) for ejecting ink to the roll paper P fed at a fixed speed, a tip end sensing sensor 109 detects the tip end position of the roll paper P. Thereafter, in synchronization with the feeding of the roll paper P, the CPU 100 sequentially reads the print information from the image memory 106. Then, the CPU 100 transfers the read print information to the respective head units 22K, 22C, 22M, and 22Y via a head unit control circuit 112.

The operation of the CPU 100 is executed based on a processing program stored in a program ROM 104. The program ROM 104 stores therein a processing program and a table corresponding to a control flow for example. The CPU 100 uses a work RAM 108 as a working memory. The CPU 100 also drives, during the cleaning and recovery operations of the respective head units 22K, 22C, 22M, and 22Y, the pump motor 124 via the output port 114 and the motor driving section 116 to thereby control the pressurization and suction of ink for example.

Figure 3:
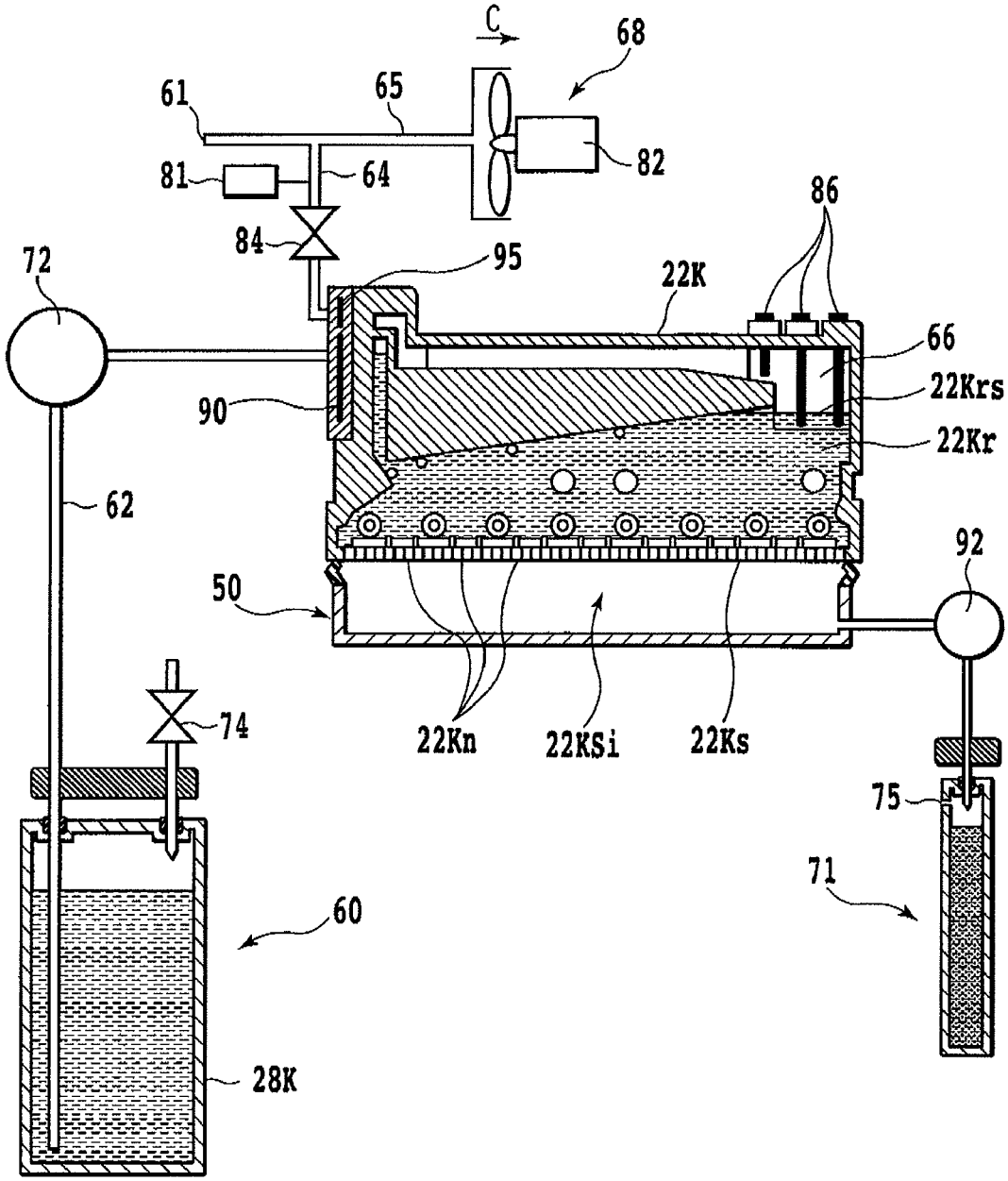
FIG. 3 illustrates an ink path from an ink tank to a head unit in the print apparatus of the first embodiment.

FIG. 3 schematically illustrates an ink path from an ink tank 28 to a head unit in the print apparatus of this embodiment. Since the respective head units have the same structure, the black ink head unit 22K will be only described as an example.

The print apparatus 10 includes a supply section 60 for supplying ink to the head unit 22K. The head unit 22K in this embodiment is structured so that a storage section 22Kr that can store ink and an ejecting section 22KSi that can eject ink as well as an air chamber 66 for storing air are provided as one unit in a common frame. However, another configuration also may be used where the air chamber 66 is not provided in the frame and the ejecting section 22KSi and the storage section 22Kr are provided in the common frame. The supply section 60 is composed of an ink tank 28K that is detachably connected to the main body of the print apparatus 10 and an ink supply pump 72 that is provided in an the ink supply path 62 connecting this ink tank 28K to the head unit 22K for example. The ink supply pump 72 supplies ink to the storage section 22Kr via an ink filter 90.

The following section will describe the head unit 22K in further detail. The storage section 22Kr is attached with a liquid level sensing sensor 86 for sensing the liquid level 22Krs of the stored ink (hereinafter also referred to as storage ink). At the lower part of the storage section 22Kr, the nozzle 22Kn of the head unit 22K is connected to the ejecting section 22KSi including an ink supply opening to the nozzle 22Kn.

At the upper part of the storage section 22Kr, a space 66 filled with air (hereinafter also referred to as air chamber) is provided. The air chamber 66 is connected to an air flow path 64 via an air filter 95.

The air flow path 64 includes an air valve 84 that can block the air flow path 64 and a pressure detection sensor 81 that can measure a pressure. The pressure detection sensor 81 can detect a pressure in the air chamber 66. If the pressure detection sensor 81 is provided in the air chamber 66 so as to directly detect the pressure in the air chamber 66, the pressure detection sensor 81 can detect the pressure in the print head 22K in a further accurate manner.

The other end opposite to one end having the air filter 95 of the air flow path 64 is connected to a decompression flow path 65 in a T-like manner. One end of the decompression flow path 65 is opened to atmosphere and the other end thereof is connected to the fan 68.

Next, the ink tank 28K will be described. The ink tank 28K is attached with a detection sensor (not shown) for detecting the existence or nonexistence of ink in this ink tank 28K. The ink tank 28K is attached with an open-air valve 74 for changing the internal pressure of the ink tank 28K to an atmospheric pressure.

When the measurement result of the storage section 22Kr by the liquid level sensing sensor 86 (detection result) shows that the ink liquid level 22Krs is equal to or lower than a fixed level, the open-air valve 74 of the ink tank 28K is opened and the supply pump 72 is operated to suck the ink in the ink tank 28K. Then, the sucked ink is supplied to the storage section 22Kr. When the liquid level sensing sensor 86 senses the ink liquid level 22Krs equal to or higher than the fixed level on the other hand, the supply pump 72 stops and the open-air valve 74 of the ink tank 28K is sealed, thereby stopping the ink supply.

By the way, the supply pump 72 uses a tube pump. When the supply pump 72 does not operate, the ink supply path 62 is blocked (a flow path between the ink tank 28K and the storage section 22Kr is blocked).

Figure 4:
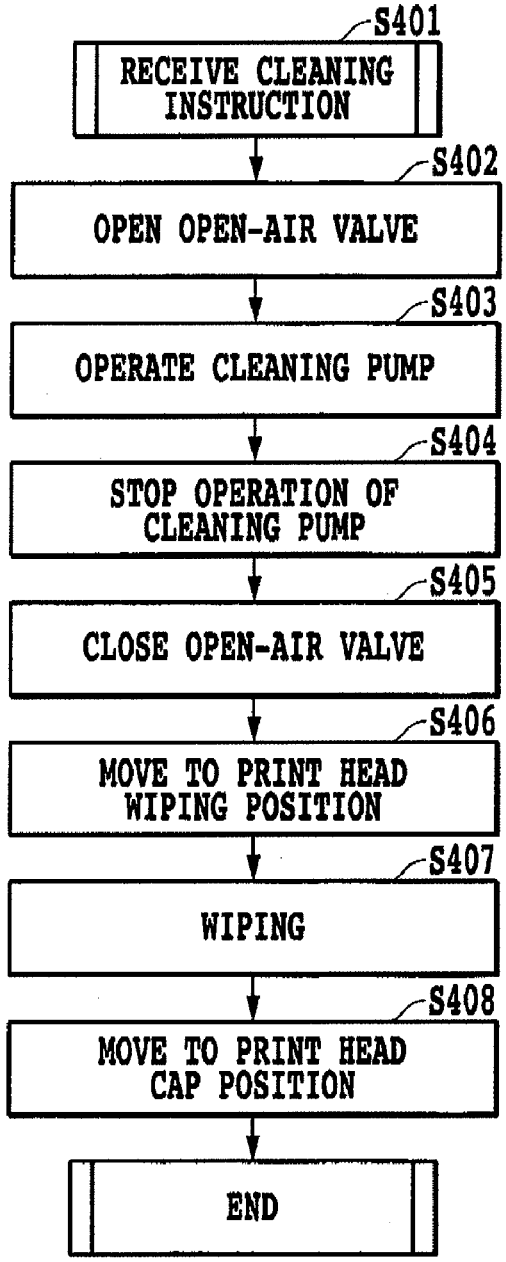
FIG. 4 is a flowchart illustrating a procedure for cleaning an ejecting opening face of the head unit.
Figure 5C:
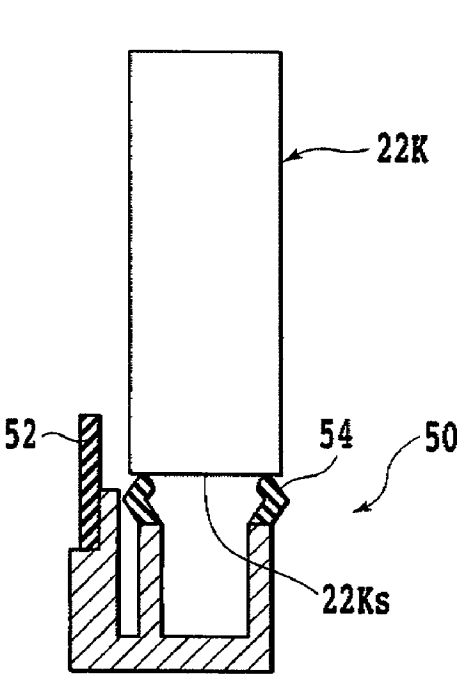
FIG. 5C is a schematic view illustrating a procedure for wiping ink by a wiper in an order from the ejecting face.
Figure 5B:
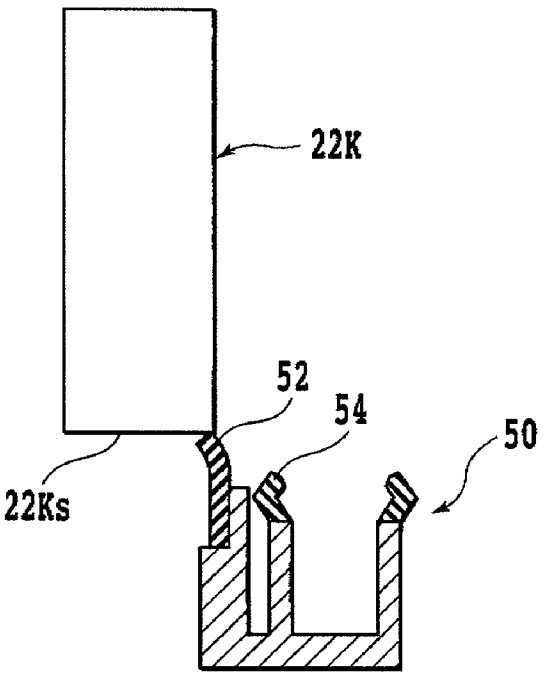
FIG. 5B is a schematic view illustrating a procedure for wiping ink by a wiper in an order from the ejecting face.
Figure 5A:
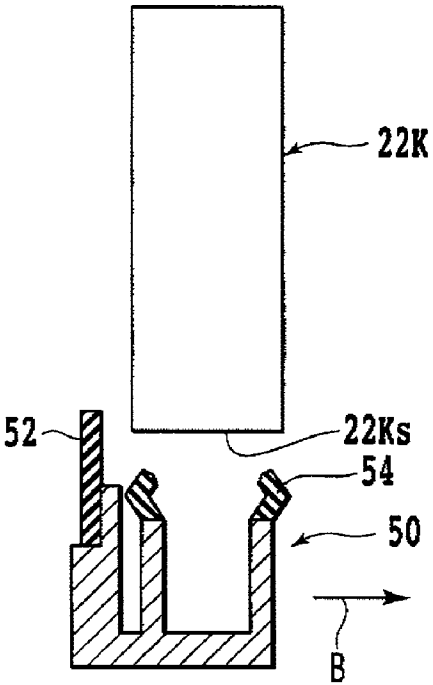
FIG. 5A is a schematic view illustrating a procedure for wiping ink by a wiper in an order from an ejecting face.

FIG. 4 is a flowchart illustrating a procedure for cleaning an ejecting opening face 22Ks of the head unit. FIG. 5A to FIG. 5C are a schematic view illustrating the procedure for wiping ink by a wiper 52 in an order from the ejecting face 22Ks. FIG. 5A shows a status prior to the start of the wiping. FIG. 5B shows a status immediately after the completion of the wiping. FIG. 5C shows a stand-by status after the completion of the wiping. The term "cleaning" herein means an operation performed in order to continuously maintain the ink ejection through the head unit 22K in a favorable status. This operation is performed automatically or arbitrarily when conditions such as the elapsed time or the ejecting situation are satisfied or when the print quality is abnormal for example. The following section will describe the cleaning operation in an order.

When a cleaning instruction is received in Step S401, then the open-air valve 84 is opened in Step S402. Thereafter, the cleaning pump 92 is driven in Step S403 so as to decompress the interior of the cap 50 and the ink in the storage section 22Kr is sucked through the nozzle 22Kn into the cap 50 and is emitted. This ink emission can remove foreign matters (e.g., minute air bubbles collected at the periphery of the nozzle 22Kn during the printing operation and the dust attached to the ejecting opening face 22Ks of the head unit). When the fixed time has elapsed, the driving of the cleaning pump 92 is stopped in Step 404 and the air valve 84 is closed in Step 405.

In this status, ink may be still attached to the ejecting opening face 22Ks including an opening of each nozzle 22Kn of the head unit 22K. In order to remove this dirt, the ejecting opening face 22Ks is wiped by the wiper 52 provided together with the cap 50 (which will be described later). For this operation, in Step S406, the head unit 22K is firstly moved to the upper part of the recovery cap 50 as shown in FIG. 5A. Thereafter, the cap 50 in Step S407 is moved in the direction shown by the arrow B. As a result, the dirt such as ink attached to the ejecting opening face 22Ks is wiped by the wiper 52 as shown in FIG. 5B. This operation is called a wiping operation. After the completion of the wiping operation, the head unit 22K is capped again in Step S408 as shown in FIG. 5C and a stand-by status is reached. The head unit 22K in this stand-by status has the ejecting opening face 22Ks capped (or blocked) by a cap abutted section 54. This substantially eliminates the air convection in the cap 50. Thus, the ink in the nozzle 22Kn can be prevented from having an increased viscosity. When the head unit 22K is in the stand-by status, the cleaning operation is completed.

The ink (waste ink) emitted through the nozzle 22Kn is received by the cap 50 and is sucked by a suction pump 92 (see FIG. 3). The sucked waste ink is pumped to a waste ink tank 71 (see FIG. 3). The waste ink tank 71 includes a minute open-air opening 75 that has a function to release, to air, the pressure in the waste ink tank 71 changing in accordance with the waste ink (and air bubbles) flowing therein.

Figure 6B:
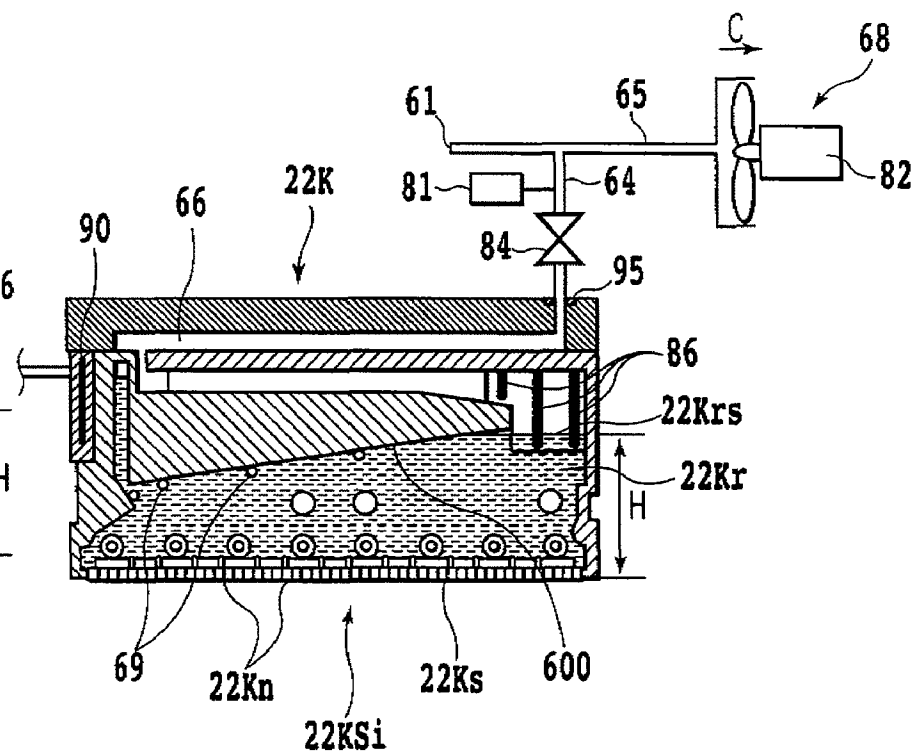
FIG. 6B is an enlarged view illustrating the head unit and the periphery thereof.
Figure 6A:
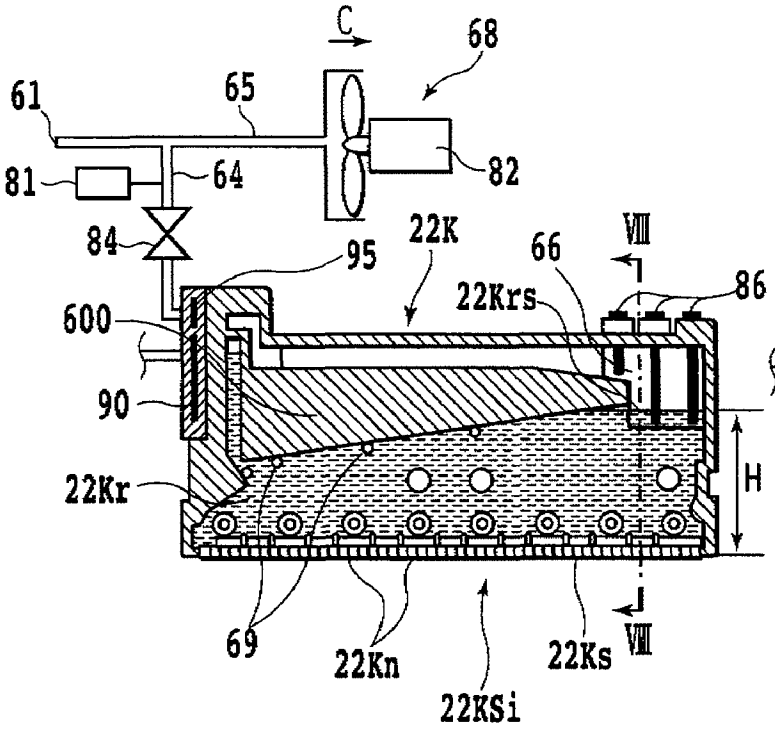
FIG. 6A is an enlarged view illustrating the head unit and the periphery thereof.

FIG. 6A and FIG. 6B are an expanded view of the head unit 22K and the periphery thereof. Meniscus is formed on the nozzle 22Kn during printing. Thus, an appropriate negative pressure must be applied to the head unit 22K. To realize this, during printing, the air valve 84 is caused to be in an open status and the fan 68 is operated so as to form the air flow in the direction shown by the arrow C to thereby decompress the air chamber 66 in the head unit 22K.

As a result, the interior of the nozzle 22Kn is similarly decompressed. This consequently applies a negative pressure to the nozzle 22Kn of the head unit 22K. In this embodiment, since the storage section 22Kr communicating with air is provided at the upper part of the ejecting section 22Ks, when the air valve 84 is opened, a positive pressure of the hydraulic head pressure H from the liquid level 22Krs acts on an opening section at a tip end of the nozzle 22Kn. Thus, the decompression amount by the fan 68 into the air chamber 66 must be set to be equal to or higher than the hydraulic head pressure H. As a result, ink meniscus is formed at the opening section of the nozzle 22Kn.

This embodiment does not use a method as disclosed in Japanese Patent Laid-Open No. 2007-327997 by which the gas in a space in which a negative pressure is generated is directly sucked by the fan 68 but uses a method as shown in FIG. 6A and FIG. 6B by which the gas is indirectly sucked. Specifically, a negative pressure generated through the operation of the fan 68 is not directly applied to the air chamber 66 but a suction opening 61 (air guide section) to which air can be guided is provided to thereby indirectly apply a negative pressure to the air chamber 66. In this embodiment, the operation of the fan 68 provides the air flow taken through the suction opening 61 to the decompression flow path 65. Then, the air in the air flow path 64 connected to the decompression flow path 65 is drawn in the air flow of the decompression flow path 65 mainly by the principle of an ejector. As a result, a negative pressure is generated in the air chamber 66.

When the air valve 84 is opened, in order to maintain the ink meniscus at the opening section of the nozzle 22Kn in an optimal status, a fixed negative pressure must be always applied to the air chamber 66. When ink is ejected through the ejecting section 22KSi, the amount of ink in the storage section 22Kr is reduced, thus causing a proportionally-reduced negative pressure in the air chamber 66. If the negative pressure in the air chamber 66 is still high, the meniscus cannot be formed at a predetermined position, thus failing to eject ink in a favorable manner. Thus, the pressure in the air chamber 66 must be adjusted in order to return, to a fixed negative pressure, the negative pressure increased in accordance with the ejecting of the ink.

This embodiment uses a method of indirectly sucking the air in the space in the air chamber 66. The existence of a part provided in a range from the air chamber 66 to the fan 68 that communicates with air always provides the air flow in the decompression flow path 65 by the rotation of the fan 68 and the air flow in the decompression flow path 65 causes the negative pressure in the air chamber 66.

In order to maintain the negative pressure in the air chamber 66 at a fixed level, it is required to control the fan 68 depending on a variation in the negative pressure in the air chamber 66 to adjust the flow rate of the air in the decompression flow path 65. For the adjustment of the flow rate as described above, constantly-flowing air is advantageous. Specifically, the air flow rate in the decompression flow path 65 automatically changes so as to absorb a variation in the pressure in the air chamber 66 even when the fan 68 is rotated with a fixed rotation speed. This eliminates the need to minutely control the fan 68 so as to follow a minute variation in the pressure in the air chamber 66. Specifically, a range within which a pressure variation can be followed under a fixed rotation speed of the fan 68 (a level at which the suction by the pressure head can be provided) is wider than in the case of the configuration as in Japanese Patent Laid-Open No. 2006-326855 (i.e., in the case where air in the air chamber is directly sucked).

Thus, the interior of the air chamber 66 can be stably maintained at a predetermined negative pressure by a relatively-simple control. When a high pressure variation is caused within a short time, the rotation of the fan 68 can be of course controlled to thereby maintain a fixed negative pressure. Furthermore, the method as in this embodiment of indirectly sucking the air in the air chamber 66 can automatically take air from the atmosphere to thereby reduce the time required for the pressure in the air chamber 66 to converge to a target value. Furthermore, by indirectly sucking the air in the air chamber 66 as in this embodiment, air in the air chamber 66 having a contact with the ink in the storage section 22Kr is prevented from being agitated significantly. This suppresses the vaporization of ink volatile components to thereby prevent ink from having an increased viscosity. Furthermore, this embodiment provides a constant air flow during the operation of the fan 68 and thus the flow can be used to cool the fan motor 82.

Figure 7:
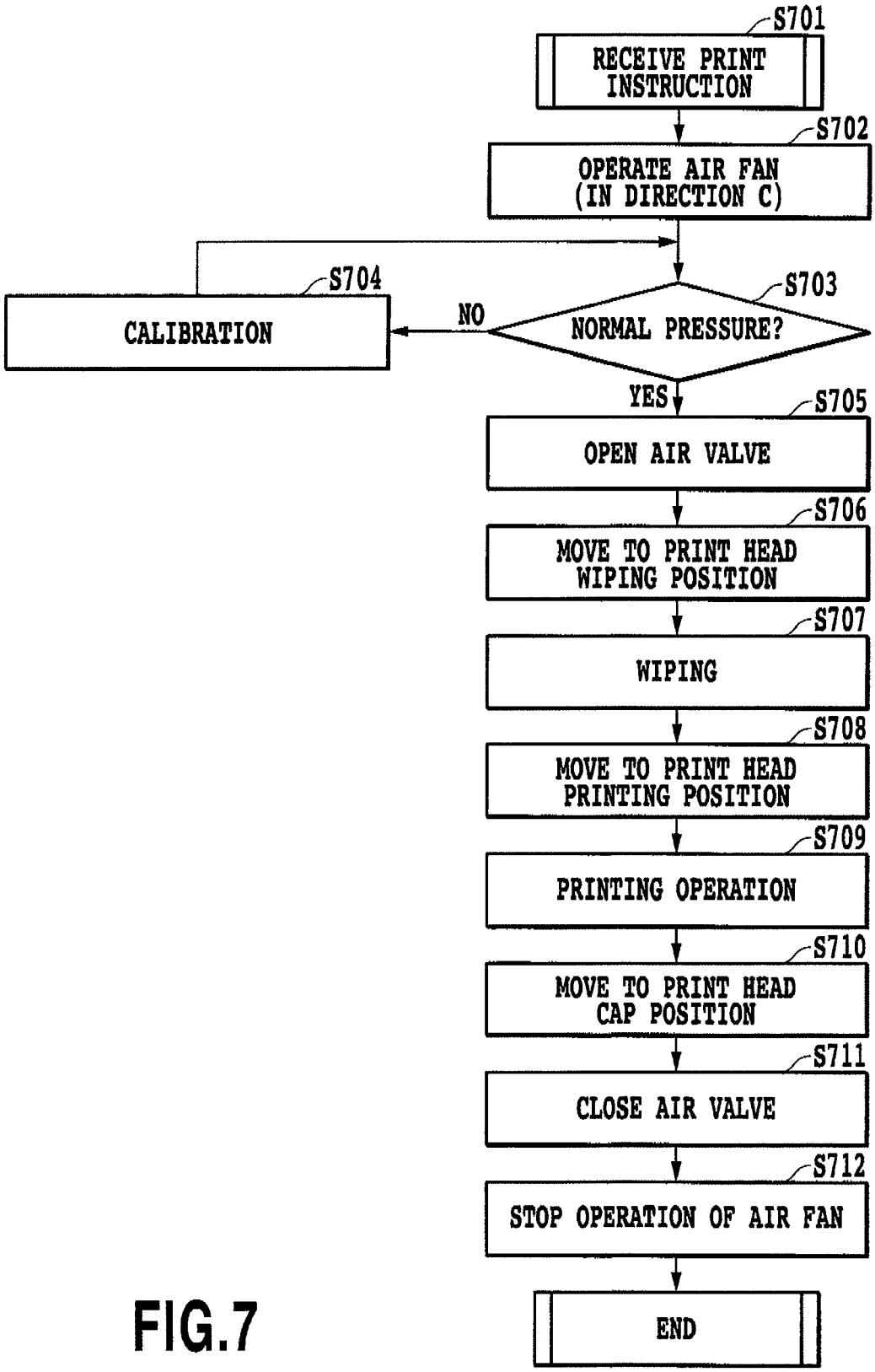
FIG. 7 is a flowchart from the reception of a print signal to the completion of the printing.

FIG. 7 is a flowchart showing the operation from the reception of a print signal to the completion of the printing. In a status where the print apparatus is not used, the air valve 84 is closed for the purpose of preventing the leakage of ink from the nozzle Kn. In order to start a printing operation, the fan 68 is firstly operated while the air valve 84 is being closed to decompress the interior of the decompression flow path 65 and the interior of the air flow path 64 before the air valve 84 is opened. The following section will describe a processing for performing the printing as described above.

When the print apparatus 10 receives a print signal in Step S701, the processing proceeds to Step S702 to cause the fan 68 to operate. Next, in Step S703, in order to confirm whether the decompression by the fan 68 is performed or not, the pressure in the air flow path 64 is confirmed by the pressure detection sensor 81. When a predetermined pressure is not obtained, the processing proceeds to Step S704 to correct the rotation number of the fan 68. When the predetermined pressure is obtained in Step S703, the processing proceeds to Step S705 to open the air valve 84. The opened air valve 84 decompresses the air chamber 66 and a negative pressure is also applied to the nozzle 22Kn. Then, meniscus is formed in an optimal status on the opening (ejecting opening) of the nozzle Kn.

Next, in Step S706, the head unit 22K is moved to a wiping position. In Step S707, the ejecting opening face 22K of the head unit 22K is wiped. Thereafter, in order to perform printing in Step 708, the head unit 22K is moved downward to the printing position. In Step 709, the print medium P is subjected to a printing operation. After the printing operation is completed, the head unit 22K is moved upward in Step S710 to the stand-by position and is capped again by the cap 50. Thereafter, in Step S711, the air valve 84 is closed. In Step S712, the operation of the fan 68 is stopped and a stand-by mode is started again, thereby completing this flowchart.

While the printing operation being executed, the ink in the storage section 22Kr is reduced due to the ink consumption by the printing. In the configuration of the head unit 22K of this embodiment, air of the same volume as that of the reduced ink is guided via the suction opening 61 and the air flow path 64 into the air chamber 66. When the liquid level sensing sensor 86 senses that the liquid level 22Krs is equal to or lower than the fixed level, the ink supply pump 72 is used to supply ink to the interior of the storage section 22Kr until the liquid level sensing sensor 86 senses the upper limit level of the ink liquid level 22Krs. Air of the volume corresponding to that of the ink flowed to the interior of the storage section 22Kr is also discharged via the air flow path 64 to the atmosphere. This consequently suppresses a pressure variation acting on the nozzle 22Kn due to the increase or decrease of the ink in the storage section 22Kr.

Figure 8:
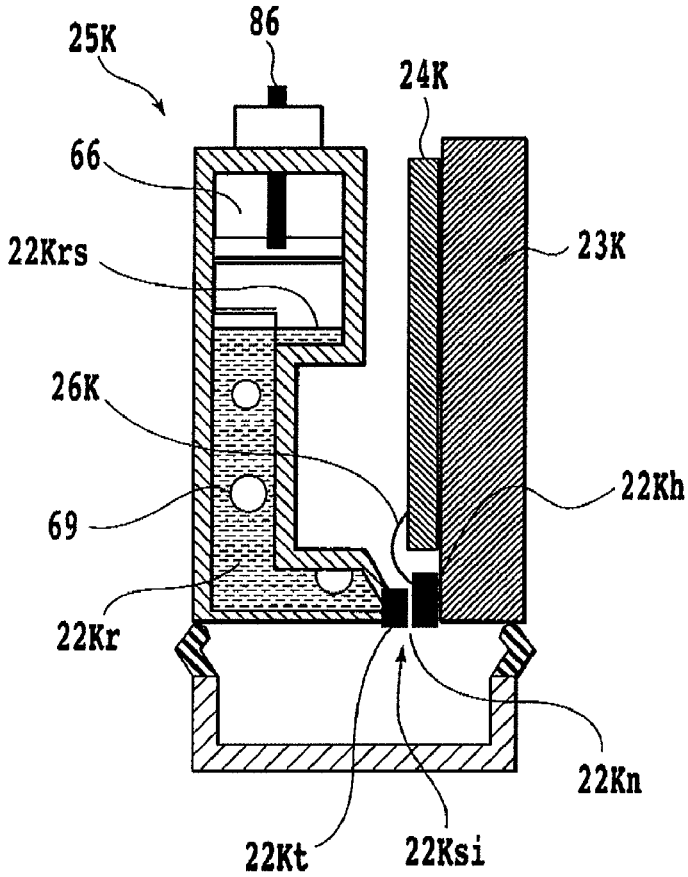
FIG. 8 is a cross-sectional view taken along the line VIII-VIII of FIG. 6A.

FIG. 8 is a cross-sectional view taken along the line VIII-VIII of FIG. 6A. The nozzle 22Kn in the ejecting section 22KSi is formed by joining two chips of a heater board 22Kh and a supply opening formation member 22Kt. The supply opening formation member 22Kt is abutted to a liquid chamber 25K forming the storage section 22Kr and communicates with the ink flow path of the supply opening formation member 22Kt. The heater board 22Kh and a head substrate 24K are connected by a power distribution wire 26K and a signal is exchanged between the head unit 22K and an external substrate. The ejecting section 22KSi, the head substrate 24, and the liquid chamber 25K for example are fixed to a base plate 23K by a means (not shown).

By the way, while the print apparatus being in a printing operation and in a stand-by status, the storage section 22Kr may include therein mixed air bubbles 69 due to the precipitation of dissolved gas in ink or an ink supply operation. The term "dissolved gas in ink" means air dissolved in ink and more air is generally dissolved in ink having a lower temperature. An example where such gas is precipitated in ink is a case where, in accordance with the move of ink to the ejecting section 22KSi during the printing operation, the heat from a heater provided in the ejecting section 22KSi causes an increase in the ink temperature. An example where the ink supplied to the interior of the storage section 22Kr includes the air bubbles 69 is gas permeation in the ink supply path 62. The interior of the ink supply path 62 is generally filled with ink. However, when the ink supply path 62 is configured by a tube for example, air in the atmosphere permeates the tube as time passes and is mixed in the interior. As described above, the air bubbles 69 are mixed in the liquid chamber 22Kr in accordance with the ink supply operation.

The air bubbles 69 thus mixed are collected so as to be accumulated and finally reach an ink supply opening 1000 and block the ink supply flow path, thereby causing a phenomenon preventing the ink supply for example. When an insufficient distance between the vapor-liquid separation liquid level 22Krs and the inlet 1001 of the air flow path 64 connected to the ink head unit 22K (hereinafter referred to as an air flow path opening 1001) is caused, the accumulated air bubbles 69 may reach the air flow path opening. Thus, a negative pressure generation method may cause a case where the negative pressure by the fan 68 may suck ink even to the air flow path 64, causing disadvantages such as a fan failure or ink scattering. In order to avoid the disadvantages as described above, a conventional approach was to emit ink not distributing to a printing operation with a predetermined interval and the air bubbles 69 are also emitted to remove the air bubbles 69 or to sweep the accumulated and collected air bubbles 69 away to a predetermined position (e.g., an ink tank).

Figure 15A:
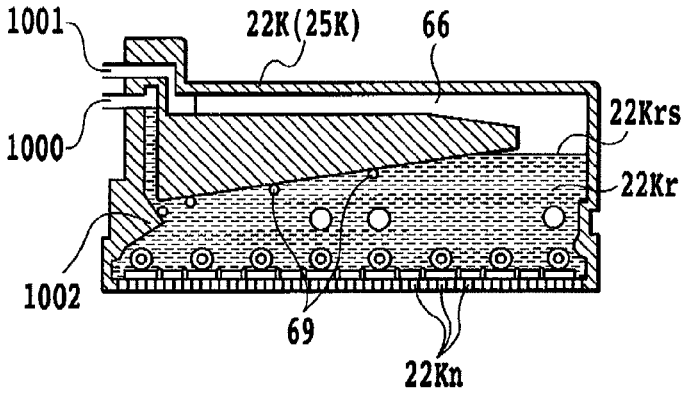
FIG. 15A illustrates a head unit in the first embodiment.

The inkjet print apparatus of this embodiment includes a guide face 600 as shown in FIG. 15A that is raised from the supply opening 1000 provided at one end of the storage section 22Kr to the ink liquid level 22Krs (air chamber 66) positioned at the other end. The guide face 600 is provided at the upper part of the storage chamber 22Krs. The flow path from the plane at which the supply opening formation member 22Kt is abutted to the liquid chamber 25K to the ink liquid level 22Krs is formed so that the guide face 600 of the top face of the liquid chamber allows air bubbles to move toward the air chamber 66-side by the buoyancy thereof. Furthermore, by providing the inclined surface at the entire upper part having the ejecting section 22KSi, air bubbles generated in the ejecting section 22KSi can be efficiently moved to the air chamber 66.

Although not shown, the surface of the guide face 600 may be subjected to a water proof treatment so that air bubbles can be moved more efficiently. The water proof treatment includes the one for coating chemical agent and the one for forming a concavo-convex surface.

By the configuration as described above, the ink flow path is prevented from being blocked by air bubbles.

The flow path from ink supply opening 1000 to the storage chamber 22Kr is similarly formed so as to prevent the upwardly-moved air bubbles 69 from entering and blocking the flow path by providing a projection 1002 in the flow path outlet in this embodiment. The projection 1002 has an inclined shape so as to prevent the air bubbles 69 from being accumulated thereon. The configuration having the projection 1002 as described above is not limited to this. The flow path outlet also may be provided so as not to be provided at the upper part of the nozzle 22Krn.

The air bubbles 69 mixed in the storage section 22Kr move upward and reach the ink liquid level 22Krs and disappear (hereinafter referred to as a vapor-liquid separation). Furthermore, by the above-described ink supply operation, the storage section 22Kr includes therein ink of an amount maintained within a fixed range. The air bubbles 69 collected by the inclined surface 600 are subjected to a vapor-liquid separation and are emitted to the atmosphere. Thus, the air bubbles 69 are prevented from being accumulated and collected in the air chamber 66 at the upper part of the storage section 22Kr. Furthermore, this embodiment provides the air chamber 66 in a range from the ink liquid level 22Krs to the air flow path opening 1001. The air chamber 66 is provided as a space separated from the storage chamber 22Krs. Specifically, a configuration is provided in which the air flow path opening 1001 and the air chamber 66 are provided at ends of the storage section 22Kr, respectively, with a distance maintained therebetween. By the configuration as described above, the air bubbles 69 existing in the ink liquid level 22Krs are prevented from reaching the air flow path opening 1001.

The configuration as described above can provide a sufficient length from the ink liquid level 22Krs to air flow path opening 1001. Thus, even when a great amount of the air bubbles 69 are mixed and is accumulated before being subjected to the vapor-liquid separation at the ink liquid level 22Krs, the air bubbles 69 are sucked by a negative pressure. This can consequently suppress a risk where the air bubbles 69 reach the outlet (the position of the fan 68). The shape of the space in the air chamber 66 and the position of the air flow path opening 1001 for example are not limited to those of the configuration as described above and may be freely determined in consideration of the configuration (see FIG. 6B).

Figure 15B:
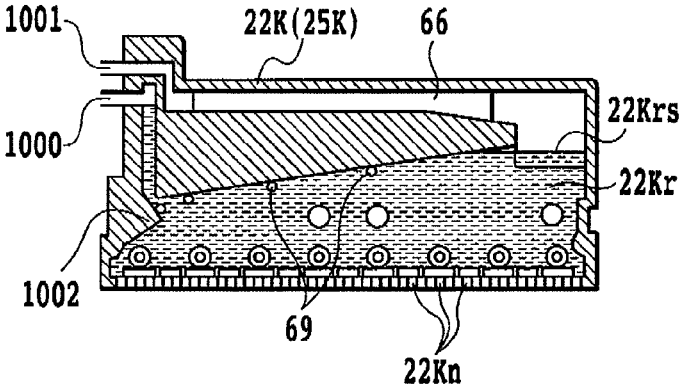
FIG. 15B illustrates the head unit in the first embodiment.
Figure 15C:
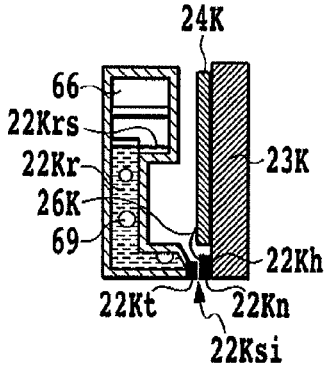
FIG. 15C illustrates the head unit in the first embodiment.

FIG. 15B and FIG. 15C illustrate a configuration where a region including the position at which the ink liquid level 22Krs is provided is at a deeper side than the storage chamber 22Kr in the thickness direction in order to provide a further favorable vapor-liquid separation. By doing so, the flow path from the storage chamber 22Kr to the ink liquid level 22Krs (air chamber 66) causes a significantly-increased cross sectional area to thereby provide an action according to which a pressure decreases in the expanded air chamber 66 and thus air bubbles in ink disappear. Thus, the vapor-liquid separation can be achieved efficiently.

Figure 15D:
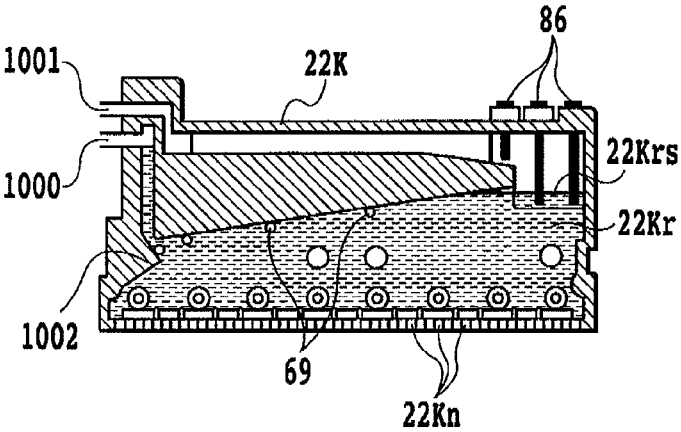
FIG. 15D illustrates the head unit in the first embodiment.

FIG. 15D illustrates the form of the head unit 22K in this illustrative embodiment. By allowing the storage chamber 22Kr to include a liquid level detection sensor 86, the ink liquid level 22Krs is detected and the ink supply can be controlled so that a predetermined position can be always reached. By providing the liquid level detection sensor 86 at the position of the ink liquid level 22Krs in the configurations shown in FIG. 15B and FIG. 15C, a favorable vapor-liquid separation can be provided to thereby perform a more accurate ink supply control without causing a wrong sensing due to the air bubbles 69.

In this illustrative embodiment, the two liquid level detection sensors 86 have a sensing position set at the upper limit height of the ink liquid level 22Krs. While ink being used, based on the amount of used ink that is reduced from this position, ink is supplied by a pump until the air bubbles 69 are sensed by the liquid level detection sensor 86. Furthermore, one liquid level sensing sensor 86 is also provided in the air chamber 66. Thus, a function is provided to sense the air bubbles 69 to stop the ink supply even when the air bubbles 69 are accumulated and enter the air chamber 66.

The invention is not limited to the configuration and control. Another configuration also may be used where another liquid level detection sensor 86 is additionally provided to sense the lower limit height of the ink liquid level 22Krs and the ink supply is performed based on the detection and the ink supply is stopped when the air bubbles 69 at the upper limit height are detected.

Furthermore, most of the air bubbles 69 are removed during a general operation as described above. Thus, it is only required at this stage to remove a small amount of the air bubbles 69 remaining in the ejecting section 22KSi. Since a small amount of the air bubbles 69 as described above exists in the vicinity of the nozzle 22Kn, the air bubbles 69 can be removed with a small amount of ink emitted due to a cleaning operation.

Figure 16:
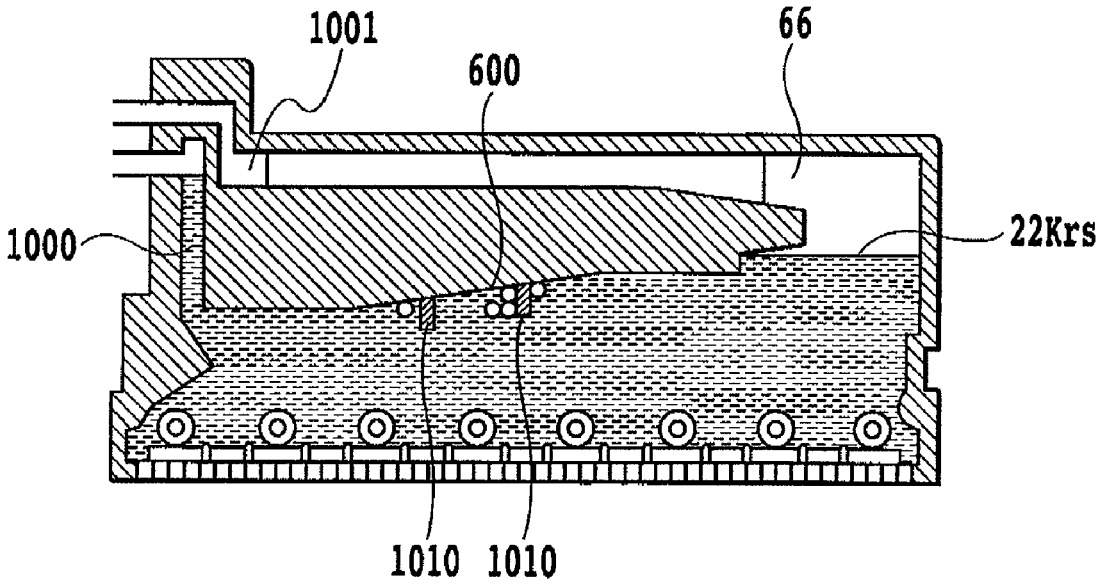
FIG. 16 illustrates the head unit in the first embodiment.

Furthermore, as shown in FIG. 16, the guide face 600 is not required to be straight from the supply opening 1000 to the ink liquid level 22Krs (air chamber 66). Thus, a partial face from the supply opening 1000 to the ink liquid level 22Krs (air chamber 66) also may include a changed section. Therefore, the guide face 600 is not limited to these shapes and may have any shape so long as air bubbles can be moved thereon as described above.

Furthermore, an air trap member 1010 also may be provided in the middle of the guide face 600 to store minute air bubbles so that air bubbles having a fixed size can be moved to the air chamber by the buoyancy thereof.

Although the storage section 22Kr in the above description has a configuration where the air bubbles 69 move from the nozzle 22Kn to the liquid level 22Krs without being blocked by anything, the invention is not limited to this. Another configuration as described below also may be used.

Although not shown, instead of the above-described print head 22K structured so that the common frame includes therein the storage section 22Kr, the ejecting section 22KSi, and the air chamber 66, another configuration also may be used where the print head 22K is configured as a print head composed of the ejecting section 22KSi and another ink storage section and the common frame includes therein the air chamber 66, the guide face 600 provided in the liquid chamber 25K, and the storage section 22Kri.

By efficiently processing the air bubbles 69 mixed in the storage chamber 22Kr in the manner as described above, a print head and an inkjet print apparatus can be realized by which various adverse effects such as an ink supply failure or the breakage of the fan 68 can be avoided and more stable continuous printing can be achieved.

MODIFICATION EXAMPLE

Figure 9:
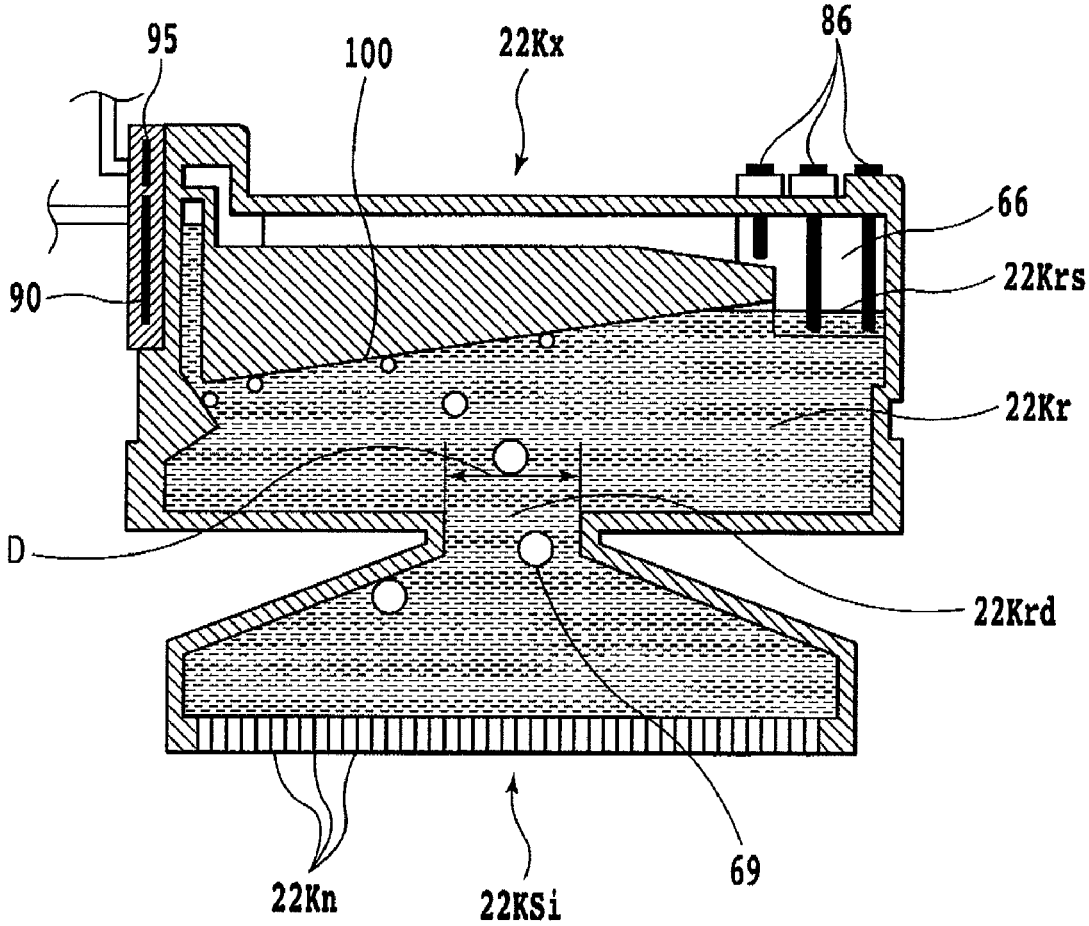
FIG. 9 is a cross-sectional view illustrating a head unit as a modification example of the first embodiment.
Figure 10:
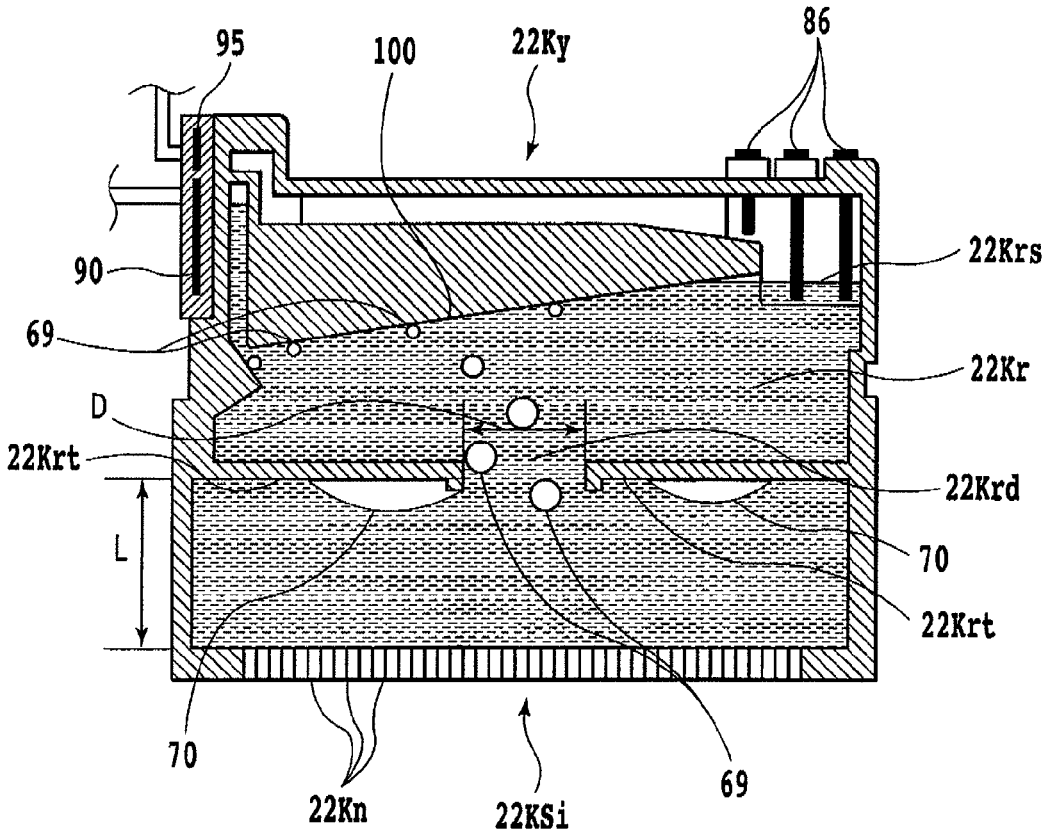
FIG. 10 is a cross-sectional view illustrating a head unit as a modification example of the first embodiment.

The following section will describe a modification example of this embodiment. FIG. 9 and FIG. 10 are cross-sectional views illustrating head units 22Kx and 22Ky as a modification example of the first embodiment, respectively. The head unit 22Kx is structured so that the storage section 22Kr has a partition in which the ejecting section 22KSi and the ink liquid level 22Krs have therebetween a flow path 22Krd. This flow path 22Krd has a width D larger than the diameter of generated air bubbles 69. Thus, the air bubbles 69 are not prevented from moving upward by the buoyancy and can reach the ink liquid level 22Krs, thereby providing a vapor-liquid separation.

The head unit 22Ky is similarly structured so that the storage section 22Kr has a partition in which the ejecting section 22KSi and the ink liquid level 22Krs have therebetween a flow path 22Krd. This partition partially includes a retention section 22Krt where air bubbles are retained. However, the retention section 22Krt is configured so that retained air bubbles 70 are partially separated before the air bubbles 69 are accumulated in an amount high enough to block the flow path 22Krd. Furthermore, the flow path 22Krd has the width D larger than the diameter of the separated air bubble 69. As a result, the separated air bubbles 69 move upward to the ink liquid level 22Krs and are subjected to a vapor-liquid separation.

Although this modification example shows an example where the head unit is integrated with the partition, the invention is not limited to this. Another configuration also may be used where the head unit is separated from the partition.

By the configuration as described above, the growth of the air bubbles 69 can be suppressed, the defoaming by a negative pressure can be promoted, and the air bubbles 69 in the storage section 22Kr can be emitted for example, thus providing a secure vapor-liquid separation. Thus, the air bubbles 69 can be prevented from being accumulated in the head unit. This could consequently reduce the frequency at which a cleaning operation is performed in order to remove the air bubbles 69 and also could reduce the ejection amount of ink not contributing to a printing operation. Furthermore, the reduced cleaning frequency could increase the print speed.

As described above, the configuration having a partition in which the ejecting section and the ink liquid level have therebetween a flow path also could realize an inkjet print apparatus by which a fan failure and ink scattering can be prevented and ink can be emitted without causing remaining air bubbles to the vapor-liquid separation liquid level the ink supply can be performed correctly.

(Second Embodiment)

Figure 11B:
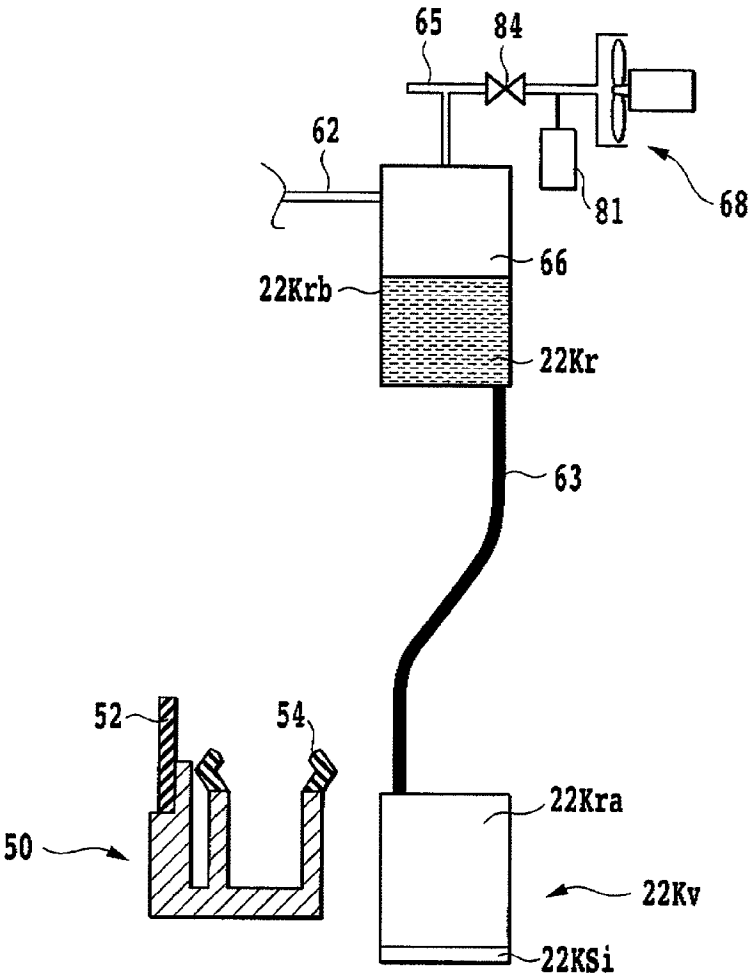
FIG. 11B illustrates the head unit of the second embodiment.
Figure 11A:
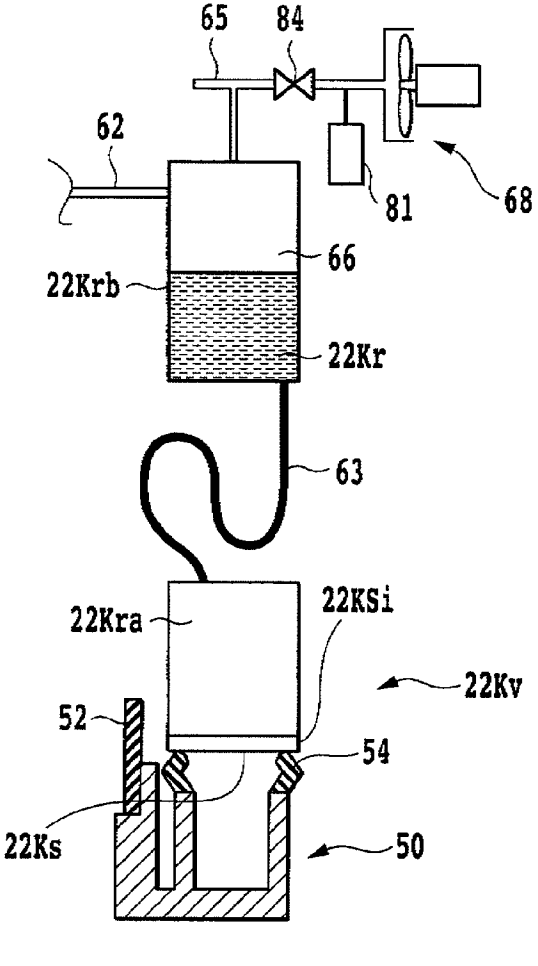
FIG. 11A illustrates a head unit of the second embodiment.

The following section will describe the second embodiment of the present invention with reference to the drawings. FIG. 11A and FIG. 11B illustrate a head unit of the second embodiment. The ink storage section of the head unit of this embodiment is divided to the second storage section 22Kra abutted to the ejecting section 22KSi and the first storage section 22Krb for performing a vapor-liquid separation that includes the storage section 22Kr and the air chamber 66 that are two separated chambers communicating with each other. FIG. 11A illustrates a status where the ejecting section 22KSi is capped. FIG. 11B illustrates a status where the ejecting section 22KSi is not capped.

The ejecting section 22KSi is abutted to the second storage section 22Kr1 and is configured as a print head section 22Kv. The second storage section 22Kra is connected to the first storage section 22Krb via an intermediate tube 63. The first storage section 22Krb is connected to a decompression mechanism having the same configuration as that of the first embodiment (e.g., the fan 68) and an ink supply path 62. The first storage section 22Krb is fixed to a main body frame. The print head section 22Kv is moved relative to the first storage section 22Krb during a printing operation and the move by a capping operation for example.

Figure 12A:
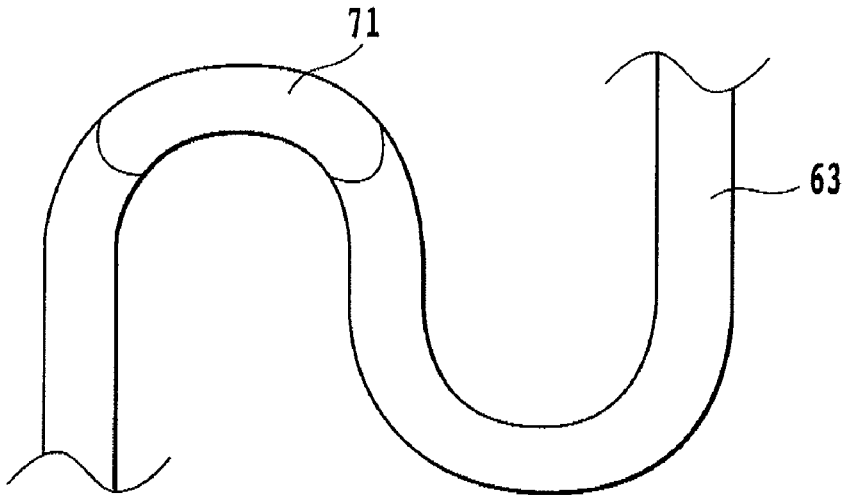
FIG. 12A is an enlarged view illustrating an intermediate tube.
Figure 12B:
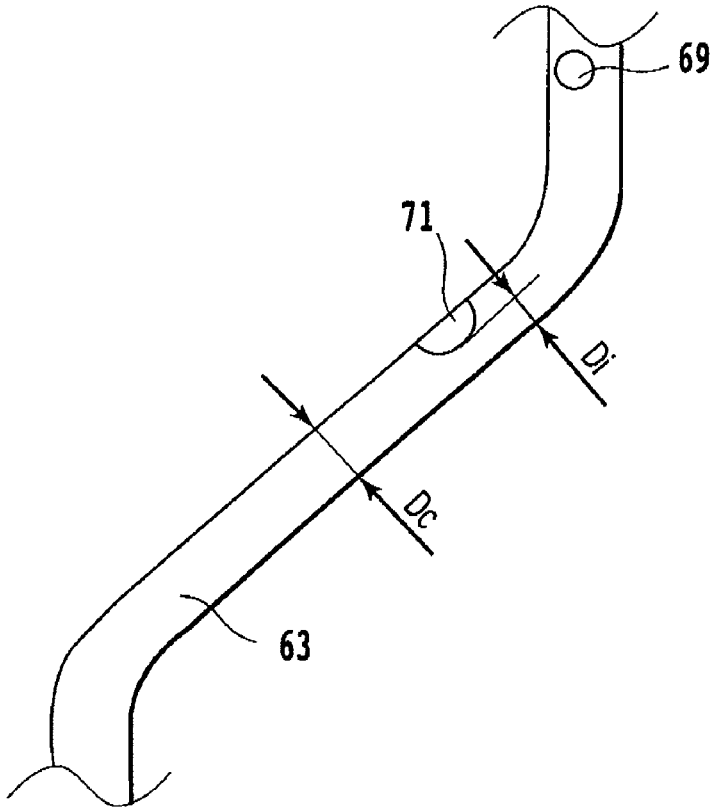
FIG. 12B is an enlarged view illustrating an intermediate tube.

FIG. 12 is an expanded view illustrating the intermediate tube 63. FIG. 12A illustrates a status of the intermediate tube 63 when the ejecting section 22KSi of the print head section 22Kv is capped. FIG. 12B illustrates a status of the intermediate tube 63 during a printing operation. As shown in FIG. 11A, when the print head section 22Kv is at a capping position, the print head section 22Kv moves closer to the first storage section 22Krb. Thus, the intermediate tube 63 is curved and a part thereof is formed to have an inverted U-like shape. Thus, the air bubbles generated in the second storage section 22Kra during the capping as shown in FIG. 12A or a printing operation forms the intermediate tube 63 may form an air bubble storage 71 at the inverted U-like shape to thereby block the ink flow path.

However, when the print head section 22Kv moves downward during a printing operation for example (moves away relatively from the first storage section 22Krb) as shown in FIG. 11B, the inverted U-like shape of the intermediate tube 63 is eliminated. As a result, the intermediate tube 63 communicates with the first storage section 22Krb because the air bubbles 26 generated in the second storage section 22Kra continuously move upward. Then, as shown in FIG. 12B, the air bubbles 69 are separated from the air bubble storage 71 and move upward by the buoyancy thereof. The ink flow path diameter Dc of the intermediate tube 63 in particular is larger than the diameter of the separated air bubbles 69. Thus, the air bubbles 69 reach the first storage section 22Krb and are subjected to a vapor-liquid separation as described in the first embodiment.

Thus, even when the ink flow path is blocked by the air bubble storage 71 during a capping operation, the ink flow path is not blocked during a printing operation for actually ejecting ink. Although a part of the air bubble storage 71 may remain in the intermediate tube 63 at this stage, the diameter Dc of the intermediate tube 63 may be set in consideration of such a case so that the minimum ink flow path Di can be secured.

By the way, in order to exchange ink exposed to the atmosphere at the opening section of the nozzle 22Kn to fresh ink before the print head section 22Kv moves from the capping position to the printing operation, ink may be ejected into the cap 50. In this case, the ink flow path blocked by the air bubble storage 71 causes an increased negative pressure in the second storage section 22Kra. However, no problem is caused since the ejected amount is small, the air bubble storage 71 itself is moved so as to be drawn to the second storage section 22Kra or expands.

As described in the first embodiment, the use of the inkjet print apparatus of this embodiment allows the air bubbles 69 to be accumulated in the head unit 22K and thus the air bubbles 69 are not collected.

As described above, the configuration where the ink storage section is divided to the third storage section and the second storage section also could realize an inkjet print apparatus by which no fan failure or ink scattering is caused and air bubbles can be entirely emitted up to the vapor-liquid separation liquid level and the ink supply can be performed correctly.

(Third Embodiment)

Figure 13:
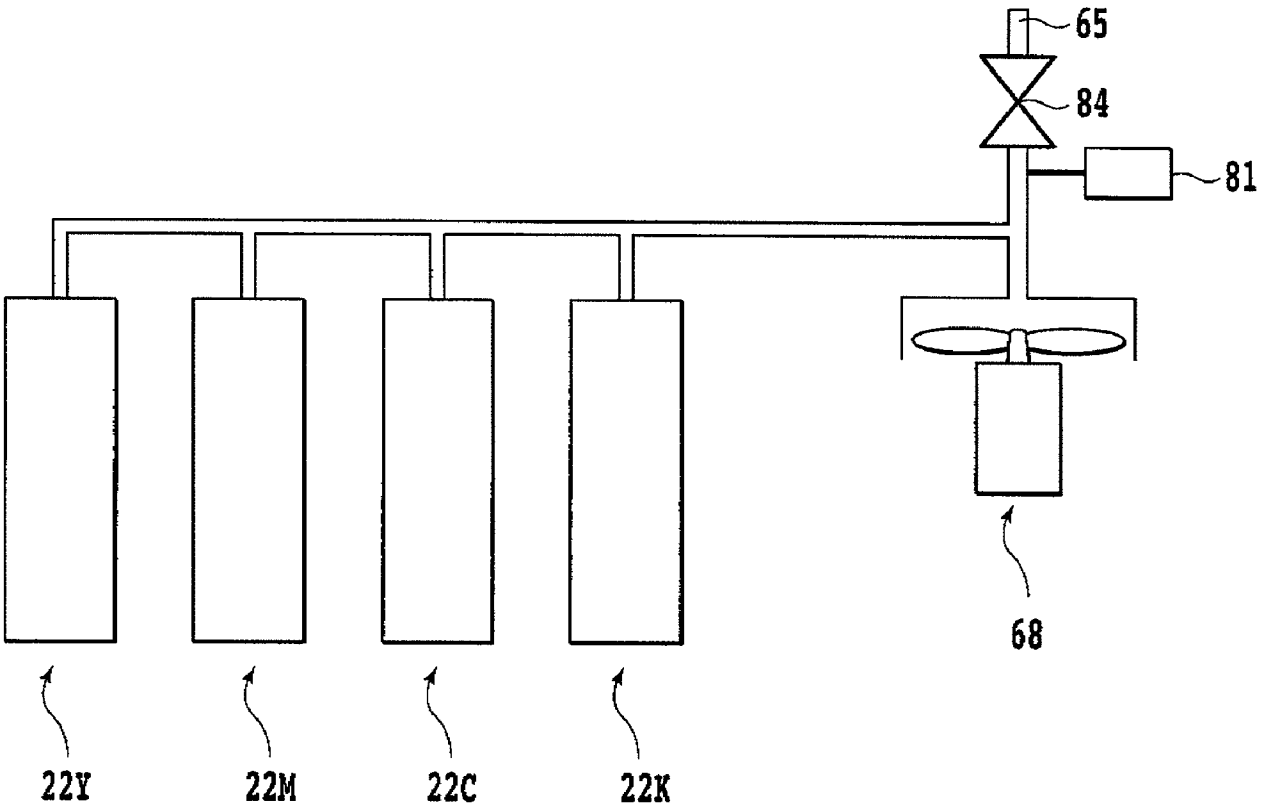
FIG. 13 illustrates a head unit and the periphery thereof of the third embodiment.

The following section will describe the third embodiment of the present invention with reference to the drawings. FIG. 13 illustrates a head unit and the periphery thereof of the third embodiment. A negative pressure control means by the fan 68 may be connected, as in this embodiment, to a plurality of head units 22Y, 22M, 22C, and 22K.

Figure 14:
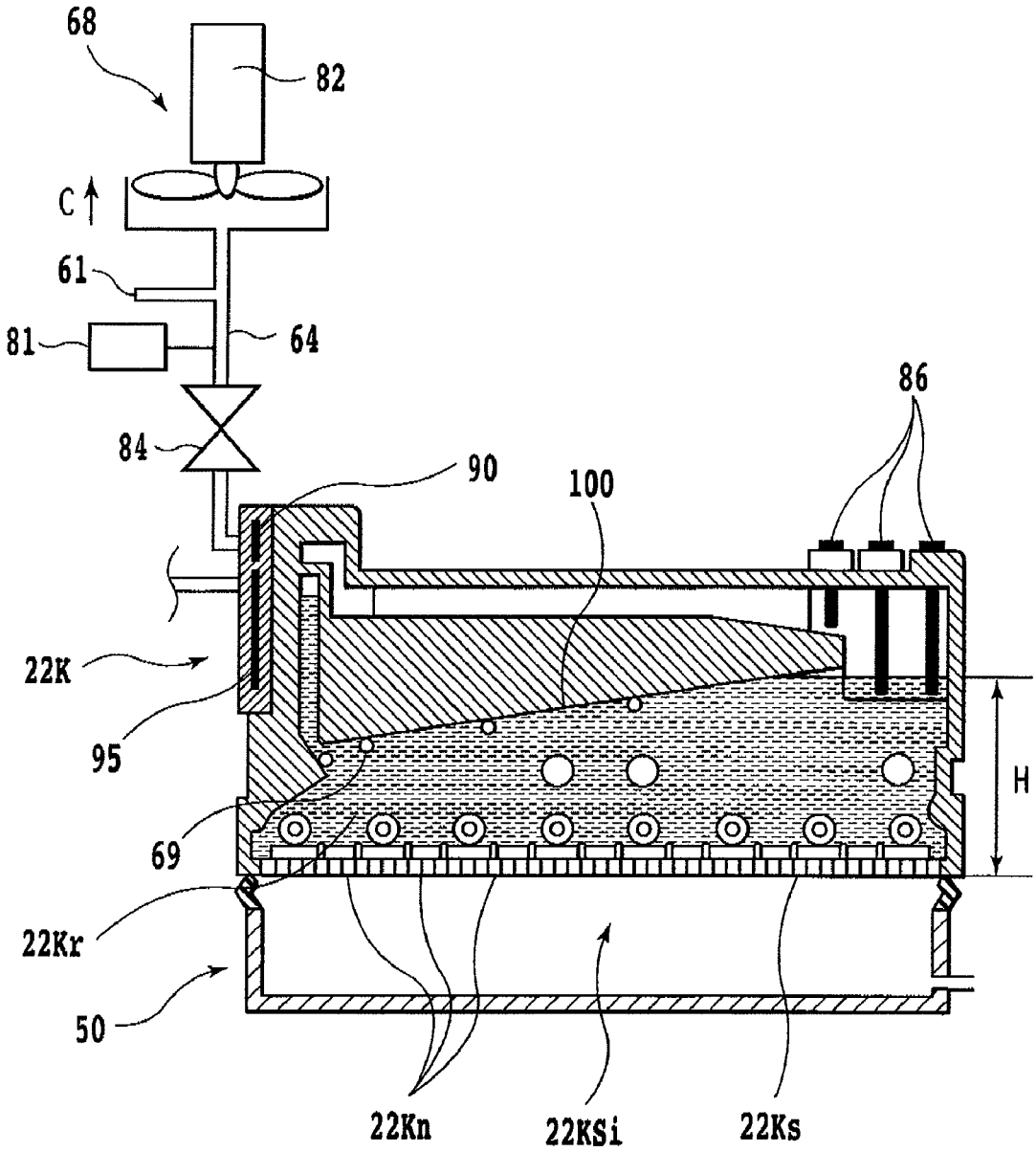
FIG. 14 illustrates an embodiment different from FIG. 13.

FIG. 14 illustrates another embodiment different from FIG. 13 of this embodiment. In the respective embodiments, the air flow from the suction opening 61 communicating with the atmosphere to the fan 68 was a straight flow. However, the invention is not limited to this. Another configuration as shown in FIG. 14 also may be used where the air flow from the air chamber 66 to the fan 68 is a straight flow in the middle of which the suction opening 61 communicating with the atmosphere is provided.

Parts of the air flow path 64 are assumed here so that a part communicating with the air chamber 66 via the air valve 84 is the first flow path, a part of the air flow path 64 communicating with the fan 68 is the second flow path, and a part communicating with the air flow path 64 and being opened to the atmosphere is the third flow path. In this case, the first flow path communicates with the second flow path in a straight manner and this communication section further communicates with (or coupled to) the third flow path. Each of the first, second, and third flow paths is not limited to one flow path. Specifically, the third flow path also may be composed of a plurality of flow paths or a flow path also may be branched or an end also may branched. Another configuration also may be used where a flow path or an end is partitioned by a wall that includes a single or a plurality of communication hole(s). A plurality of fans also may be configured. The effect of the present invention can be clearly obtained through any configuration so long as the configuration allows the pressure in the head unit is decompressed to be decompresses by using a fan suction force to guide air through the air flow path communicating with the atmosphere to suck air through the air flow path.

The configuration as described above also could realize an ink supply apparatus and an inkjet print apparatus by which the negative pressure control of ink supplied to the ink ejecting section can be simplified to provide a accordingly-simplified apparatus configuration to thereby provided a reduced cost.

(Fourth Embodiment)

Although the above-described illustrative embodiments have used an inkjet print apparatus using a negative pressure generating means, the present invention is not limited to this. The effect of the invention also can be provided in an exemplary configuration where only the water head difference from an ink tank is used to apply a negative pressure to the nozzle 22*kn* and the fan 68 is substituted with a pump for sucking ink to supply ink to the storage chamber 22Krs. This can consequently avoid an influence on a pressure stability and a pump characteristic due to the air bubbles 69 entering the pump flow path.

As described above, any external mechanism of the head unit 22K connected to the air flow path opening 1001 can be used and can similarly realize the effect of the invention.

Although the respective embodiments have showed an example in which a controller for controlling a negative pressure in the head unit is provided in the print apparatus, the invention is not limited to this. The controller also may be provided in a head unit as an ink supply apparatus.

Although the respective embodiments have described a full line-type print apparatus, the invention is not limited to this, a serial-type print apparatus also may be used where the maintaining of a print head and the feeding of a print medium are performed alternately.

Although the respective embodiments have used, as a negative pressure generating mechanism, a so-called non-positive-displacement pump that is a propeller-type fan, the invention is not limited to this. A positive-displacement pump also may be used.

Although the embodiment have described a configuration where the first storage section is connected to the second storage section via an intermediate tube and the intermediate tube provides both of a function to supply ink and a function of a pathway of air bubbles moving from the second storage section to the first storage section, the invention is not limited to this. Another configuration also may be used where, in addition to an ink supply path for supplying ink form the first storage section to the second storage section, another pathway for guiding air bubbles generated in the second storage section to the first storage section.

Finally, the term "print" (also may be called image formation) herein is not limited to the formation of significant information such as characters and graphics. Specifically, the term "print" also widely includes the formation of an image, a design or the like on a print medium or the processing of a medium regardless of whether it is significant or insignificant or whether it is actualized so as to be visually recognized by human.

Furthermore, the term "print medium" (also called a sheet) is not limited to a paper used in general print apparatuses and also widely includes an object that can accept ink (e.g., cloth, plastic, film, metal plate, glass, ceramics, wood, leather).

Furthermore, the term "ink" should be widely interpreted as in the definition of "print". Specifically, ink means to include liquid that is applied on a print medium to form an image, a design, a pattern or the like or to process a print medium or to process ink (e.g., to solidify or to insolubilize the coloring material in ink applied to a print medium). The apparatus of the present invention also may use liquid other than ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-027194, filed Feb. 9, 2009, and Nos. 2010-015550, filed Jan. 27, 2010, which are hereby incorporated by reference herein in their entirety.

What is claimed is:

1. An ink storage apparatus comprising:

an ejecting section that ejects ink droplets to a print medium;

a liquid chamber that stores the ink ejected from the ejecting section;

an air chamber that is provided at an upper part of the liquid chamber;

a separate section that separates the liquid chamber and the air chamber;

a connecting section that connects the liquid chamber and the air chamber and that is provided at the end of the separate section;

a guide face that is provided at an upper part of the liquid chamber and that is inclined to an ejection face of the ejecting section and that guides air bubbles in the liquid chamber to the connecting section; and an air flow path opening that is provided in the air chamber and that is connected to an outside;

wherein the connecting section is provided at a first end side of the ink storage apparatus in direction that the ejecting section is formed, the air flow path opening is provided at a second end side of the ink storage apparatus opposite the first end side in the direction that the ejecting section is formed, and the connecting section is not provided at the second end side of the ink storage apparatus.

2. The ink storage apparatus according to claim 1, wherein a cross-section of a flow path which constitutes the air chamber is larger than a cross-section of a flow path which forms the liquid chamber.

3. The ink storage apparatus according to claim 1, wherein the liquid chamber, the air chamber and the guide face are provided in a common frame.

4. The ink storage apparatus according to claim 1, wherein the ink storage apparatus includes a sensor that detects a liquid level of ink having entered the air chamber.

5. The ink storage apparatus according to claim 1, wherein the ink storage apparatus includes a pressure reduction device that is connected via the air flow path opening and that emits air in the air chamber to atmosphere for pressure reduction.

6. The ink storage apparatus according to claim 1, wherein the ink storage apparatus includes a supply opening that supplies ink to the liquid chamber, and the supply opening is provided at the second end side of the ink storage apparatus.

7. The ink storage apparatus according to claim 1, wherein the ink storage apparatus includes a filter and the filter is provided at the air flow path opening.

8. An inkjet print head ejecting ink droplets to a print medium comprising:

an ejection opening that ejects ink droplets;

a liquid chamber that stores ink ejected from the ejection opening;

an air chamber that is provided at an upper part of the liquid chamber;

a separate section that separates the liquid chamber and the air chamber;

a connecting section that connects the liquid chamber and the air chamber and that is provided at the end of the separate section;

a guide face that is provided at an upper part of the liquid chamber and that is inclined to an ejection face of the ejecting section and that guides air bubbles in the liquid chamber to the connecting section; and an air flow path opening that is provided in the air chamber and that is connected to an outside;

wherein the connecting section is provided at a first end side of the inkjet print head in direction that the ejecting section is formed, the air flow path opening is provided at a second end side of the inkjet print head opposite the first end side in the direction that the ejecting section is formed, and the connecting section is not provided at the second end side of the inkjet print head.

9. The inkjet print head according to claim 8, wherein a cross- section of a flow path which constitutes the air chamber is larger than a cross-section of a flow path which forms the liquid chamber.

10. The inkjet print head according to claim 8, wherein the liquid chamber, the air chamber and the guide face are provided in a common frame.

11. The inkjet print head according to claim 8, wherein the inkjet print head includes a sensor that detects a liquid level of ink having entered the air chamber.

12. The inkjet print head according to claim 8, wherein the inkjet print head includes a pressure reduction device that is connected via the air flow path opening and that emits air in the air chamber to atmosphere for pressure reduction.

13. The inkjet print head according to claim 8, wherein the inkjet print head includes a supply opening that supplies ink to the liquid chamber, and the supply opening is provided at the second end side of the inkjet print head.

14. The inkjet print head according to claim 8, wherein the inkjet print head includes a filter and the filter is provided at the air flow path opening.

* * * * *